US006003949A

United States Patent [19]

Rinne et al.

[11] Patent Number: 6,003,949

[45] Date of Patent: Dec. 21, 1999

[54] CHAIR SEAT CUSHION AND CHAIR SEAT WITH SUCH A CUSHION

[76] Inventors: Tommi Rinne, Jarnaldersringen 847, Haninge, Sweden, 136 67; Yrjö Rinne, Skyttens gata 53, Haninge, Sweden, 136 61

[21] Appl. No.: 09/029,986

[22] PCT Filed: Sep. 20, 1996

[86] PCT No.: PCT/SE96/01168

§ 371 Date: Mar. 13, 1998

§ 102(e) Date: Mar. 13, 1998

[87] PCT Pub. No.: WO97/10735

PCT Pub. Date: Mar. 27, 1997

[30] Foreign Application Priority Data

Sep. 21, 1995 [SE] Sweden ..... 9503280
Dec. 14, 1995 [SE] Sweden ..... 9504481

[51] Int. Cl.[6] ..... A47C 7/02

[52] U.S. Cl. ..... 297/452.21; 297/284.3; 297/452.28

[58] Field of Search ..... 297/452.21, 452.25, 297/452.23, 452.28, 337, 344.12, 284.1, 284.3, 284.11, 338, 452.48, 452.55; 5/652, 657

[56] References Cited

U.S. PATENT DOCUMENTS 1,455,234 5/1923 Thompson .
2,139,028 12/1938 Mensendicck et al. ..... 155/28
2,845,998 8/1958 Estabrook et al. ..... 155/184
3,511,537 5/1970 Ackermann .
4,126,355 11/1978 Rosenheck .
4,153,294 5/1979 Meiller et al. ..... 297/284
4,334,709 6/1982 Akiyama et al. ..... 297/284
4,574,901 3/1986 Joyner .
4,773,703 9/1988 Krugener et al. .
5,286,089 2/1994 Goldman .
5,294,181 3/1994 Rose et al. .
5,338,099 8/1994 Ishi et al. ..... 297/452.33
5,352,023 10/1994 Jay et al. .
5,441,331 8/1995 Vento ..... 297/452.33

FOREIGN PATENT DOCUMENTS 43 00 602 7/1994 Germany .
95/33396 12/1995 WIPO .

*Primary Examiner*—Milton Nelson, Jr.
*Attorney, Agent, or Firm*—Jacobson, Price, Holman & Stern, PLLC

[57] ABSTRACT

A chair seat cushion for use with a chair having a backrest, as well as a chair fitted with such a cushion, that improves seating comfort and reduces load on the user's lumbar region. The cushion has a bevelled front edge and a bevelled concave rear edge. The length of the cushion is such that, when properly placed on the seating surface of a chair for use, the user's knees and calves are in front of and out of contact with the front edge, while the user's hips are in generally vertical alignment with the rear edge such that the user's buttocks extend behind the rear edge. With the user's back supported by the backrest, the user's weight is largely supported on the thighs, thereby reducing lumbar load.

16 Claims, 2 Drawing Sheets

CHAIR SEAT CUSHION AND CHAIR SEAT WITH SUCH A CUSHION

BACKGROUND OF THE INVENTION

1. Field of the Invention

The present invention relates to a chair seat cushion for a chair having a backrest and to the use of such a cushion.

The invention also relates to the seat cushion fitted to a chair, i.e. a chair fitted with said cushion.

In one embodiment, the invention relates to a chair seat cushion that can be placed on the seat of a chair having a backrest, to improve user seating comfort and particularly to enable the user to adjust his/her seating position in the chair.

The inventive chair seat cushion is intended to be used by people who are healthy with the exception of possible back pains, wherein the cushion is intended to be used to prevent the occurrence of back pains and to reduce or eliminate back pains of people who have or are prone to back troubles.

2. Description of the Related Art

Earlier techniques concerning contoured and structured chair seats are represented in U.S. Pat. No. 5,352,023, U.S. Pat. No. 4,726,624 and WO-A 94/10878, all of which relate to wheelchairs and more specifically to wheelchair seats that are designed for a different purpose to that intended by the invention, namely primarily to prevent a person seated in a wheelchair from sliding forwards on or from the chair seat, for instance in the event of an abrupt stop.

The wheelchair seat has a sunken rear part which receives the user's back to this end. The transition from the rear sunken part of the seat and the front raised part forms a barrier which functions to prevent the user from slipping forwards. A wheelchair-bound user will often lack the ability to feel or correct an unsuitable hip position in the wheelchair. The seat can be given the "right" length with respect to the horizontal distance between the user's back and his/her bent knees, by enabling the whole of the wheelchair seat to be moved longitudinally in relation to the wheelchair back rest. In order to enable the barrier to be positioned so that the user's back/hips lie more or less stably enclosed between the barrier and the wheelchair backrest, the use of narrow strap-like cushions which are supported across the seat and function to raise the front seat part have been proposed. These cushions can be arranged or removed to displace the effective position of the barrier along the seat.

When applying the known technique, it has been noted that roughly 75% of the user's body weight is transferred to the seat over an area of about 25 square centimeters (corresponding to the leg sitting area). In order to distribute this load over a wider area, it has been proposed to raise the aforesaid narrow barrier cushions to a level in which they project up over the level defined by the front part of the seat, thereby forming a pivot ridge which enables the weight of the user's thighs and legs to establish a pivotal moment around this ridge which tends to reduce the surface pressure on the user's back. The aforesaid technique also proposes the use of a liquid-filled cushion placed on the wheelchair seat to reduce the otherwise local high external load pressure on the user, or patient.

SUMMARY OF THE INVENTION

In distinction, an object of the present invention is to provide a chair chariest cushion which can be placed in a longitudinally adjustable position on a chair seat of a chair that has a backrest, with the intention of enabling people who are otherwise essentially healthy to adopt a sitting position in which the persons back is relieved of load and to reduce, when applicable, back pains which would otherwise occur when a person is seated, or to prevent the occurrence of back pains in sitting positions.

Another object of the invention is to show the use of the chair seat cushion and also to provide a chair equipped with a chair seat cushion of the aforesaid kind that can be readily brought by the user to and from a use position in the chair.

The invention is basically comprised in an essentially rigid chair seat cushion whose width will at most correspond to the width of a conventional chair seat The cushion will have an effective thickness of about 35 mm, for instance. The length of the cushion will be much shorter than the length extension of the chair seat, so as to enable the cushion to be moved to different longitudinal positions on the chair seat without the front edge of the cushion protruding beyond the front edge of the chair seat in normally occurring use positions. The inventive cushion may therefore have a length of about 28 cm in one practical embodiment thereof. The cushion itself may be comprised of a generally flat rectangular plate having a thickness of about 40 mm, said plate having formed in the upper side thereof two shallow, basin-like recesses or indentations which are intended to receive the rear parts of the respective thighs of the user. The upper front edge of the plate is preferably gently bevelled down to half the plate thickness through, an angle of about 45 degrees. The rear edge of the plate is also preferably softly bevelled, wherein the angle between the bottom surface of the plate and the upwardly and forwardly sloping bevelled face is preferably about 30 degrees. The rear edge of the cushion has a slightly concave shape, wherein the concave rear edge extends essentially along an arcuate part whose pitch or height relative to a circle chord intersecting both rear comers of the cushion advantageously lies in the region of 10–25 mm in the case of a cushion whose width is approximately 400–450 mm.

It has surprisingly been found that the inventive cushion can be moved on a chair seat with the front edge of the cushion generally parallel with the front edge of the chair seat to a position in which the user can sit comfortably on the cushion and, at the same time, feel relief in his/her lumbar region and/or obtain a comfortable curvature of the lumbar with the user's back in contact with the chair backrest.

The rear edge of the cushion will then normally be located approximately in a vertical plane extending through the user's hip joints, wherein the user's back/hip region will be essentially relieved of load and, in principle, hang behind the rear, preferably concave edge of the cushion. The chair backrest supports the user in his/her lumbar region and the friction that is generated between the backrest and the user's back coacts to support the torso of the user. Since the vertical plane through the center of gravity of the user's torso extends close to the rear edge of the cushion, the weight of the user will exert a small turning moment around the rear edge of the cushion. The user is therefore able to hold his/her hip part/back raised from the chair seat, or at least maintain a reduced load thereon quite easily with the aid of his/her own muscular force, so that the user's weight will also be favourably distributed over the backs of the user's thighs to the upper side of the cushion. This results in relieving the load on the user's lumbar region and also enables the user to readily curve the lumbar region in the median plane, therewith back pains or minimizing the risk of the occurrence of back pains in a person sitting on the inventive cushion.

The inventive cushion is thus primarily intended for use by a person whose muscles are intact such as to enable the user to establish a comfortable sitting position on the cushion and chair after adjusting the inventive cushion to the best position in the forward/rearward direction of the cushion.

Because the inventive cushion has no rear side-edge parts which laterally support the user's hips, the inventive cushion has no parts which make it difficult for the user to change arching of his/her lumbar region in the forward/rearward direction of the chair, or prevent such changes.

As indicated in the aforegoing, it is important that the rear edge of the cushion can be placed essentially in the vertical plane extending through the hip joints of a seated user with the user's back in comfortable contact with the chair backrest. In this way, the user's weight will be taken-up to a substantial degree or almost completely by the chair backrest and the cushion, i.e. the front part of the cushion, whereas the user's weight will only be taken-up by the rear part of the cushion to a small extent or essentially not at all. In conventional seating furniture, essentially all of the weight of a seated person is transferred to the rear part of the chair seat with the lumbar of the person being subjected to substantial compression forces. A person using an inventive cushion such that the person's back will exert no load on the rear part of the chair seat, the lumbar region of the person concerned will instead be subjected to a tensile force, which is often desirable. The user can thus adjust the cushion position to obtain desired compression or tensile forces in the lumbar region within certain limits, by adjusting the level difference between the upper surface of the seat cushion (the front part of the cushion) and the rear part of the seat cushion.

When effecting a change in level, it is important that the boundary or demarcation line between the front and the rear part of the cushion is located in the region of a vertical plane that extends through the user's hip joints with the user in good contact with the backrest.

BRIEF DESCRIPTION OF THE DRAWINGS

The invention will now be described in more detail with reference to exemplifying embodiments thereof and also with reference to the accompanying drawings, in which.

DETAILED DESCRIPTION OF THE PREFERRED EMBODIMENTS

Figure 2:
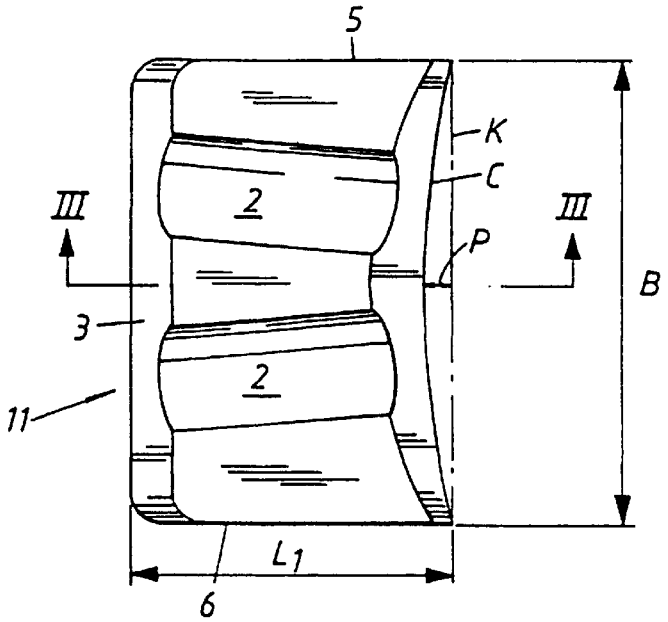
FIG. 2 shows the inventive chair seat cushion from above.
Figure 3:
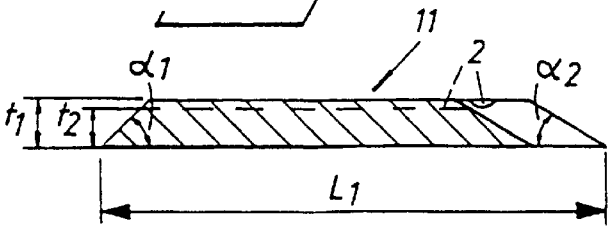
FIG. 3 is a sectional view taken on lines III—III in FIG. 2.

It will be evident from FIGS. 2 and 3 that the inventive chair seat cushion 11 has a basic construction which can be said to include a generally rectangular and essentially rigid plate to, i.e. the plate be compressed by the weight of people sitting thereon. The cushion 11 may conveniently be comprised of Frigolite or some other expanded, relatively rigid plastic material.

As will also be evident from FIGS. 2 and 3, the cushion 11 has a generally flat under surface and a generally flat upper surface parallel therewith, wherein the cushion has a total thickness $t_1$ of 40 mm. In a horizontal position, the cushion has a generally straight front edge which is bevelled at 3 adjacent the upper surface of the cushion. Both side edges 5, 6 of the cushion 11 are generally parallel with one another and extend at right angles to the front edge of the cushion.

The rear edge of the cushion 11 extends along a circular arc c. A chord K of the arc c intersects the intersection of said arc c with the side edges 5, 6. The pitch P between the arc and the chord is about 25 mm. The rear edge has a bevel or chamfer 4. The front bevel 3 defines an angle $\alpha 1$ of about 45 degrees with the bottom plane. The rear bevel 4 defines an angle $\alpha 2$ of about 30°, wherein the bevel 4, at least in its longitudinal center region, extends essentially down to the bottom plane. In a practical embodiment, the bevel surface 4 has a length of about 70 mm in the longitudinal center region of the cushion 11, wherein the length of the bevel decreases continuously in a direction towards the side edges 5, 6 of the cushion 11, where the length of the bevelled surface is about 30 mm and said surface spreads from the upper surface of the cushion 11 down to a point corresponding to roughly half the thickness of the cushion.

Provided in the upper side of the cushion 11 are two generally basin-shaped and generally mutually parallel recesses or indentations 2 that have a depth of about 5 mm from the top surface of the cushion 11 along the whole of their lengths. The recesses or indentations 2 thus open out in the front and rear bevelled surfaces 3, 4.

The effective sitting height $t_2$ of the cushion 11 from the bottom plane is therewith about 35 mm; $t_2$ may be in the range of 25–45 mm and $t_1$ in the range of 20–50 mm. The cushion 11 need not necessarily include recesses 2, and if recesses are provided thev will preferably have a depth of 5–15 mm, preferably about 5 mm.

The cushion 11 of one preferred embodiment has a length $L_1$ of about 280 mm and a width B of about 400 mm.

Figure 1:
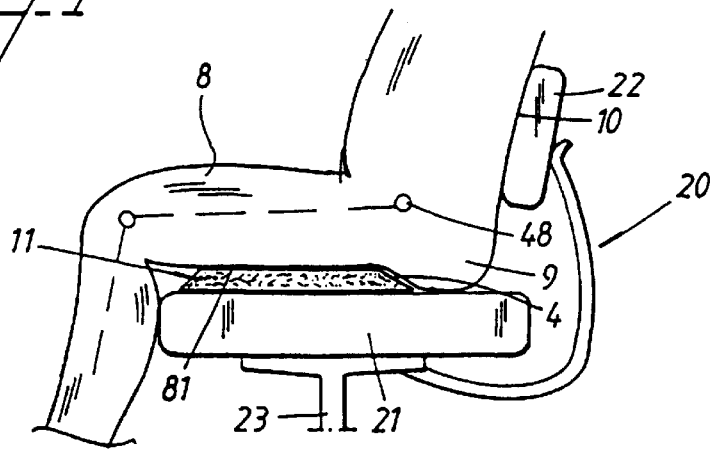
FIG. 1 is a schematic side view of a chair provided with an inventive chair seat cushion.

FIG. 1 illustrates a chair 20 having a seat 21 and a backrest 22. The cushion 1 is placed on the seat 21 with the front edge of the cushion generally parallel with the front edge of the seat 21. The cushion 11 can be moved in the longitudinal direction of the seat 21 to an approximate position in which the rear bevel surface 4 is located roughly beneath the hip joints 48 of a user whose lumbar region is in contact with the backrest 22 and who is seated in a comfortable position. It will be seen that the user's thighs 8 rest on the cushion and that the underside 81 of the thighs are received in the recesses 2 in the cushion, and it will be understood that the friction generated between the backrest 22 and the user's back 10 will assist in supporting the torso of the user. This means that the user's hip region and back 9 are able to sink down in the sunken area defined beneath the upper surface of the cushion 11 behind said cushion and above the chair seat 21. The curvature and inclination of the user's back in the median plane can now be easily adjusted in an optimal fashion, since the surface pressure between the user's back 9 and the chair seat 21 has been reduced, and since the shape of the user's back 9 has a limited influence on the setting of optimal angles between the user's hips and thighs and between the user's hip region and lumbar region and curvature of the lumbar.

Because the hip joints 48 are located in the region above the rear bevelled edge 4 of the cushion, the rotational moments of force established around an axis corresponding to the area of the bevelled surface 4 in contact with the user will be small, whereby the user is able to ensure that the pressure against his/her back 9 and the backs 81 of the thighs can be equalized without needing to strain the muscles to any appreciable extent, whereby the surface pressure on the rear bevelled surface 4 is also limited.

Although the cushion 11 is essentially rigid, i.e. is not compressed by the weight of the user, it will be understood that the actual cushion 11 may still be slightly flexible in order to conform to some extent to any contours in the chair seat 21, the length of which will normally be about 45 cm.

Figure 4:
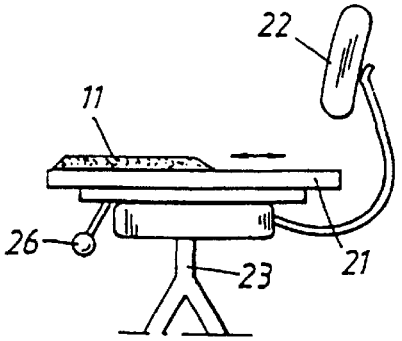
FIG. 4 illustrates a chair on which the cushion is fixedly mounted on the chair seat, which can be moved in the longitudinal direction thereof.

In the FIG. 4 embodiment, the inventive seat cushion 11 is, in principle, fixedly connected to or integrated with the chair seat 21, said seat being movable longitudinally in relation to the chair backrest 22. Mobility of the seat in its longitudinal direction can be achieved by conventional means, for instance by guiding the seat in guides fitted to the chair chassis 23, wherein conventional latching means 26 enable the seat to be locked or released for locking and moving the seat in the guide means.

The chair may, in general, be any type of chair, for instance a working chair, such as an office chair having conventional degrees of freedom with regard to adjustability.

Figure 5:
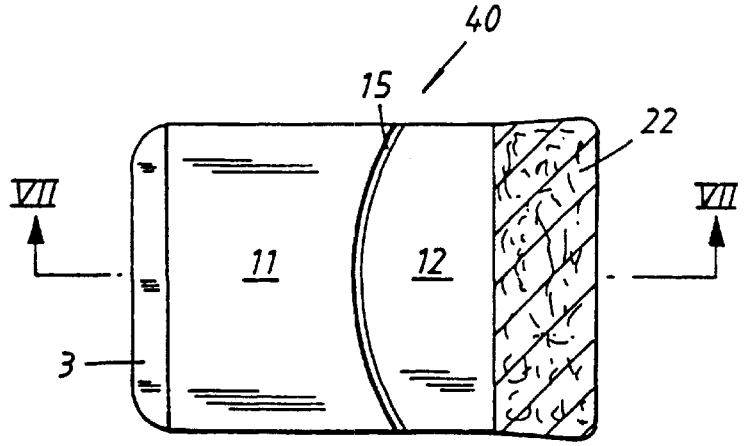
FIG. 5 is a partially sectioned horizontal view of a chair according to the invention.
Figure 7:
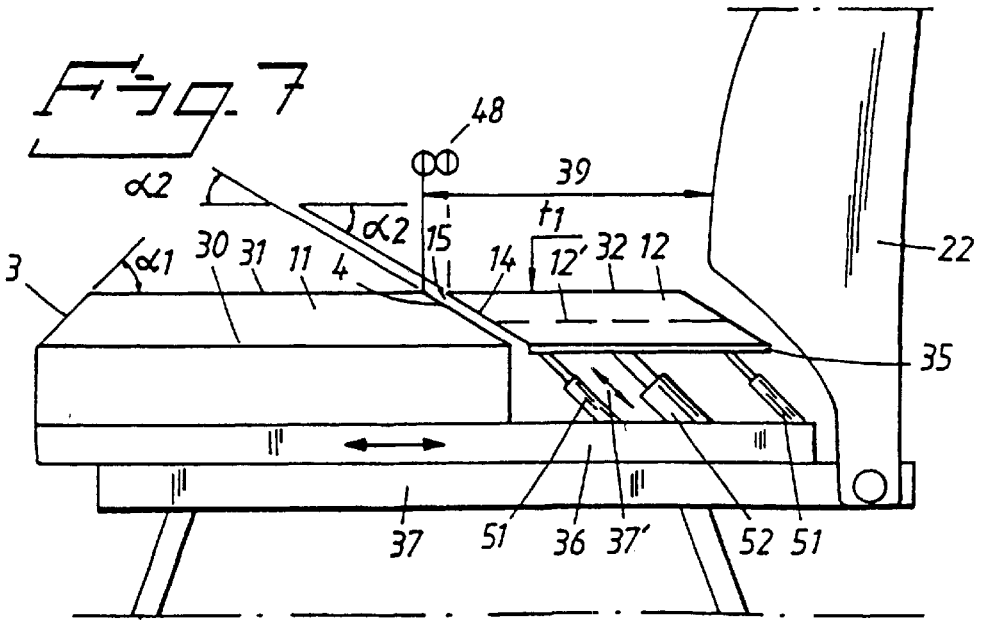
FIG. 7 is a schematic sectional view taken on the line VII—VII in FIG. 5.

FIGS. 5 and 7 illustrate an inventive chair which includes a backrest 22 and a chair seat 40 comprising a front seat part 11 and a rear seat part 12 that adjoins the backrest 22. In a first position of use, the parts 11 and 12 can be assumed to form together a continuous seating surface, as conventional with chairs, armchairs, car seats, etc. For the sake of simplicity, the front seat part 11 and the rear seat part 12 are shown with their upper free surfaces lying in a common horizontal plane. It will be understood, however, that the outwardly facing surface of the seat 40 may be contoured in accordance with conventional techniques, to afford the comfort provided by such techniques. Thus, the front edge of the seat part has a raised part which supports against the backs of the user's thighs. This raised part may be displaceable in the plane of the seat surface, which normally slopes downwardly towards the rear of the seat. The seat may also be provided conventionally with a raised part on each long side thereof, to prevent or restrict lateral sliding movement. The front part 11 of the seat may therewith widen between these raised side parts.

When the rear seat part 12 is lowered and raised in relation to the front seat part, movement of the seat is effected by generally vertical parallel displacement.

It has been observed that the ability to lower the rear seat part through a distance of about 35 mm is favourable to many users, although the height difference which will provide an optimal effect can be chosen with the aid of suitable seat lowering devices.

Figure 6:
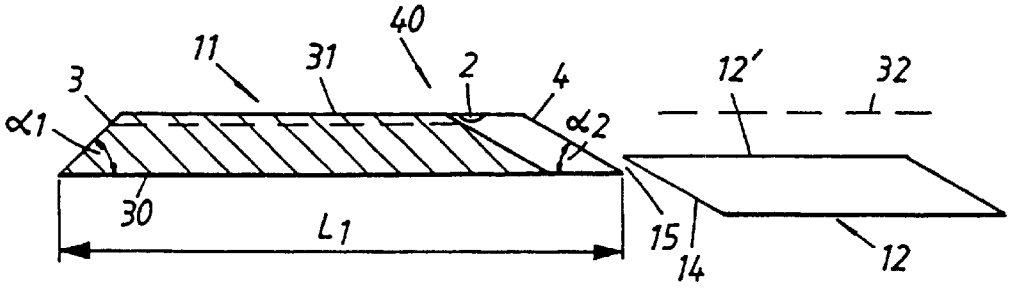
FIG. 6 is a central, vertical longitudinal sectioned view of the chair seat in a user position.

It will be seen from FIGS. 6 and 7 that the rear edge 4 of the front seat part 11 is bevelled, with the bevel 4 sloping downwardly towards the rear. The rear seat part 12 has a front bevelled surface 14 which is generally complementary to the surface 4, so as to leave only a small or negligible gap 15 between the parts 11, 12.

In the illustrated case, the rear seat part 12 is supported on a support plate 35 which is guided for parallel movement in relation to a chassis 37 in a direction 37' parallel with the slope angle $\alpha 2$ of the bevelled surface 4, so that the joint 15 between the parts 11, 12 will remain essentially closed during parallel movement of the rear seat part 12. The line 30 in FIG. 7 defines a surface which is parallel with the upper surface 31 of the front seat part 11 and which is shown to lie in the horizontal plane, wherein the plate 35 and the upper surface of the rear seat part 12 can be assumed to lie in the horizontal plane.

The parts 11, 12 are supported from a base plate 36 which in turn can be displaced in the longitudinal direction of the chair in relation to a chassis 37. This enables changes to be made to the distance 39 between the backrest 22 and the position of the rear edge region 4 of the front seat part 11. The distance 39 can be set so that the user's hip joints 48 will lie generally in a vertical plane through the joint 15 when the user's back is in contact with the backrest 22. The support plate 35 of the rear seat part 12 is supported from the base plate 36 via guides 51 which enable parallel movement of the plate support 35 in the direction 37' by means of a plate moving device 52, which in the illustrated case is an hydraulic cylinder that can be driven by a pump, not shown. A spring device may be mounted between the cylinder 52 and its base plate 36 in order to absorb shock loads. Furthermore, conventional shock absorbers may be connected between the support plate 35 and the base plate 36 to dampen forces that act generally vertically or in the direction 37'.

The backrest 22 may be tilted to a desired angle with the aid of conventional means, and the whole of the seat may be movable vertically and horizontally and may optionally also be tiltable to enable the front edge/rear edge of the seat to be raised/lowered.

The rear seat part 12 can now be lowered by means of the device 52, so as to move its effective upper surface in parallel down to an effective level 12' which lies about 35 mm beneath the original level of said part 12, with the upper surfaces of the seat parts 11, 12 in more direct connection with one another.

FIG. 6 shows that the front seat part 11 has a generally flat upper surface 31 which either lies level with the upper surface 32 of the rear seat part 12 or, when the rear seat part 12 is lowered to a lower limit position 12', lies at a level about 40 mm above the surface 12'. Seen in a horizontal projection, the seat part 11 has a generally straight front edge having a bevelled surface 3 joining the upper surface 31. Both side edges 5, 6 of the seat part 11 are essentially parallel with one another and extend generally at right angles to the front edge.

As shown in FIG. 2, the rear edge of the seat part 11 extends in a circular arc C whose center lies in the longitudinal center plane of the part 11. A chord K to the arc C intersects the intersection of the arc C with the side edges 5, 6. The pitch P between the arc and the chord is about 25 mm in one preferred embodiment. The rear edge part of the seat part 11 has a bevelled surface 4. As shown in FIGS. 3 and 7, the front bevel 3 defines an angle $\alpha 1$ with the surface 30, this angle reaching to about 45°. The rear bevel 4 defines an angle $\alpha 2$ of about 30° relative to the surface 30, wherein the bevel 4 extends, at least in its length central region, substantially down to a level corresponding to the bottom most end position 12' of the upper surface 32 of the rear seat part 12. In one practical embodiment, the length of the bevelled surface 4 in the plane of the surface 31 is about 70 mm in the length center region of the front seat part 11, wherein the length of the bevelled surface 4 continuously decreases in a direction towards the side edges 5, 6, where the length of the bevelled surface 4 in the plane 31 is about 30 mm. In this case, the rear edge of the bevelled surface 4 lies at about 40 mm beneath the surface 31 in the length center region of the front seat part 11, and at a distance of about 20 mm beneath the plane 31 at the edges 5, 6.

Formed in the upper side of the front seat part 11 are two generally basin-like shallow recesses or indentations 2 which extend in the longitudinal direction of the chair and which have a depth of about 5 mm from the upper surface 31 along the full length of the front seat part 11. The recesses 2 thus open out in the front and rear bevelled surfaces 3, 4 and function to receive the backs of the user's thighs.

Looking to FIG. 7, the rear seat part 12 can be moved vertically between the illustrated levels 32 and 12', wherein the vertical movement path is normally about 35 mm. It will be understood, however, that the device 52 enables the movement path to be finely adjusted. Because the hip joints of the user will be located vertically above the joint or junction 15, the user's back will be lowered when the rear seat part 12 is lowered, so as to reduce the surface pressure between the user's back and the seat part 12. In this regard, it can be assumed that the vertical pressure on the user's back will be reduced, so as to relieve the user's back. Because the user's back will be in contact with the backrest 22 and the pelvis region of the user will be located on the chamfered surface 4 and his/her thighs in contact with the upper surface of the front seat part 11, the user will obtain a comfortable seating position.

In one optimal embodiment of the invention, the front seat part 11 has a length $L_2$ of about 280 mm. Its width B may be about 400 mm. In the case of chairs that have raised side supports, such as car seats for instance, the width B may be smaller and correspond to the free space between said raised supports. The distance between the front side of the backrest 22 and the front edge of the front seat part 11 will normally be about 45 mm, but can be adjusted by virtue of the mobility of the base plate 36 in relation to the chassis 37 and the backrest 22.

The rear seat part 12 can be moved up vertically to about 50 mm, wherein when lowered in accordance with the invention, said rear seat part will be located at a level of 25–45 mm beneath the level of the upper part 31 of the front seat part 11. The rear seat part 12 is normally moved in parallel in a generally vertical direction.

The pitch P of the arcuate rear edge of the front seat part 11 will generally lie in the region of 10–45 mm and preferably reaches to about 25 mm. The total length $L_1$ of the front seat part 11 lies in the region of 24–30 cm, and is preferably about 28 cm.

We claim:

1. A chair seat cushion for a chair having a backrest and a seat surface, said cushion for reducing lumbar load to a user sitting thereon, the cushion having a length of between 24–30 cm, said length being less than a depth of the seat surface such that, when the cushion is situated on a forward part of the seat surface for use, a portion of the seat surface adjacent the backrest is uncovered, the cushion comprising a front edge, a concave rear edge, two side edges, a bottom surface, and an upper thigh-supporting surface, the concave rear edge extending essentially around a circular arc having a pitch relative to a circle chord that intersects the arc at the side edges of between 10–45 mm, wherein the rear edge of the cushion is placed in a position essentially immediately beneath the user's hip joints with the user's thighs against the upper surface and the user's calves out of contact with the front edge of said cushion, the upper thigh-supporting surface of the cushion at a height of at least 15 mm above the uncovered portion of the chair seat surface adjacent the backrest, such that the user's body is supported on the thighs and against the backrest, with the user's back on a vertical plane behind the rear edge of the cushion.

2. The cushion according to claim 1, wherein the pitch relative to the circle chord that intersects the arc at the side edges is about 25 mm.

3. The cushion according to claim 1, wherein the length of the cushion is about 28 cm.

4. The cushion according to claim 1, wherein the rear edge is bevelled, sloping from the bottom surface forwardly and upwardly to define an angle with the bottom surface of about 30°, wherein the bevelled rear edge has a width of about 70 mm in a longitudinal direction of the cushion in a center plane region thereof.

5. The cushion according to claim 1, wherein the cushion is operably coupled to the forward part of a chair seat that can be moved forwards and backwards to a selected position in relation to a chair backrest.

6. The cushion according to claim 1, said upper surface including two basin-shaped and generally mutually parallel recesses extending from the front edge to the rear edge, said recesses for receiving a back part of the user's thighs, the basin-shaped recesses having a depth of between 5–15 mm.

7. A chair for adjustable supporting a weight of a seated person on the person's hips to reduce lumbar stress comprising a seat and a backrest, the seat including a front part and a rear part separated by a boundary, the front part including a top portion with a thickness of between 20–50 mm, the top portion having a front edge, a concave rear edge, two side edges, a bottom surface, and an upper thigh-supporting surface, said front edge being bevelled, sloping from the bottom surface rearwardly and upwardly to define an angle with the bottom surface of about 45°, the concave rear edge extending essentially around a circular arc having a pitch relative to a circle chord that intersects the arc at the side edges of between 10–45 mm, the front part and the rear part being movable vertically in relation to one another between a first position in which the upper thigh supporting surface and a rear part top surface generally lie in a common plane and both surfaces support a respective substantial part of the weight of a seated person, and a second position (in which the upper thigh supporting surface lies on a substantially higher level than the rear part top surface and the upper thigh supporting surface supports a greater part of the weight of the seated person than does the rear part top surface.

8. The chair according to claim 7, wherein the boundary between the front and the rear parts as seen in a horizontal plane is generally perpendicular to a longitudinal direction of the chair, said boundary being located approximately in a vertical plane passing through the positions of the hips of a seated person.

9. The chair according to claim 7, further comprising means for selectively adjusting the mutual vertical movement positions of said front and rear parts, the rear part top surface adjustably moving in parallel from a position level with the upper thigh supporting surface to a position between 25–45 mm below the upper thigh supporting surface.

10. The chair according to claim 7, wherein the seat can be moved longitudinally for adjustment of the boundary position relative to the back support in the longitudinal direction of the chair.

11. A chair seat cushion for use on a chair with a backrest by a person having hips, buttocks, thighs, knees and calves, the cushion comprising:

a generally straight front edge, a concave rear edge, two side edges, a flat bottom surface for resting on a seat of said chair, and a top surface to engage and support said person;

said top surface including two basin-shaped and generally parallel channels extending from the front edge to the rear edge, said channels spaced for receiving a back part of the person's thighs;

said concave rear edge spaced from said front edge at a distance such that the hips are positioned in generally vertical alignment with the rear edge while the buttocks extend behind the rear edge, with the knees and calves in front of and out of contact with the front edge, whereby the person is supported on the thighs and against the backrest.

12. The cushion according to claim 11, wherein said concave rear edge extends essentially around a circular arc having a pitch, relative to a circle chord that intersects the arc at the side edges, of between 10–45 mm, and wherein said channels have a depth of between 5–15 mm.

13. The cushion according to claim 11, wherein said rear edge is bevelled, sloping from the bottom surface forwardly and upwardly to define an angle with the bottom surface of about 30°, the bevelled rear edge having a width of about 70 mm near a longitudinal center line of the cushion and decreasing continuously in a direction toward the side edges where the width is about 30 mm.

14. The cushion according to claim 13, wherein the bevelled rear edge near the side edges extends from the upper surface to a point corresponding to about half a thickness of the cushion.

15. The cushion according to claim 11, wherein the distance between the front edge and the rear edge is between 24–30 cm.

16. The cushion according to claim 11, wherein said front edge is bevelled, sloping from the bottom surface rearwardly and upwardly to define an angle with the bottom surface of about 45°.

* * * * *